US012798039B2

(12) United States Patent
Miyazaki et al.

(10) Patent No.: US 12,798,039 B2
(45) Date of Patent: Nov. 17, 2026

(54) DOUBLE-SIDE POLISHING APPARATUS AND DOUBLE-SIDE POLISHING METHOD FOR WORKPIECES

(71) Applicant: SUMCO Corporation, Tokyo (JP)

(72) Inventors: Yuji Miyazaki, Tokyo (JP); Keiichi Takanashi, Tokyo (JP); Shingo Azuma, Tokyo (JP)

(73) Assignee: SUMCO CORPORATION, Tokyo (JP)

( * ) Notice: Subject to any disclaimer, the term of this patent is extended or adjusted under 35 U.S.C. 154(b) by 433 days.

(21) Appl. No.: 18/564,870

(22) PCT Filed: Mar. 8, 2022

(86) PCT No.: PCT/JP2022/010113
§ 371 (c)(1),
(2) Date: Nov. 28, 2023

(87) PCT Pub. No.: WO2022/254856
PCT Pub. Date: Dec. 8, 2022

(65) Prior Publication Data

US 2024/0261929 A1 Aug. 8, 2024

(30) Foreign Application Priority Data

Jun. 4, 2021 (JP) ..... JP2021-094673

(51) Int. Cl.
*B24B 37/013* (2012.01)
*B24B 37/08* (2012.01)

(52) U.S. Cl.
CPC ..... *B24B 37/013* (2013.01); *B24B 37/08* (2013.01)

(58) Field of Classification Search
CPC ..... B24B 37/013; B24B 37/08; B24B 37/04; B24B 37/28; B24B 49/04; B24B 49/12; H10P 52/00
See application file for complete search history.

(56) References Cited

U.S. PATENT DOCUMENTS

2017/0355060 A1* 12/2017 Park ..... B24B 37/013
2020/0346319 A1 11/2020 Kubota et al.
2021/0245321 A1 8/2021 Kubota et al.

FOREIGN PATENT DOCUMENTS

CN 101006562 A * 7/2007 ..... B24B 9/065
CN 111295740 6/2020
(Continued)

OTHER PUBLICATIONS

English translation of JP 2020015122A (Year: 2020).*
(Continued)

*Primary Examiner* — Makena S Markman
*Assistant Examiner* — Sukwoo James Chang
(74) *Attorney, Agent, or Firm* — GREENBLUM & BERNSTEIN, P.L.C.

(57) ABSTRACT

Provided is a double-side polishing apparatus for workpieces capable of terminating double-side polishing at the timing when the entire workpiece and the peripheral portion of the workpiece each have the target shape. A computing section: obtains, from thickness data of each workpiece measured by a workpiece thickness measuring device a shape index of the entire workpiece; and determines, as a timing of terminating double-side polishing, a timing at which the shape index of the entire workpiece is a set value of the shape index determined based on a difference between a target value of the shape index in a current batch and an actual value of the shape index in a preceding batch and a deviation of an actual value of a shape index of a peripheral portion of the workpiece in the preceding batch from a target range of the shape index in the current batch.

12 Claims, 9 Drawing Sheets

(56) References Cited

FOREIGN PATENT DOCUMENTS

| | | | | |
|---|---|---|---|---|
| CN | 112672848 | | 4/2021 | |
| JP | 2010-30019 | | 2/2010 | |
| JP | 5153894 | B2 * | 2/2013 | ..... B24B 9/148 |
| JP | 2019-118975 | | 7/2019 | |
| JP | 2020-15122 | | 1/2020 | |
| KR | 10-2021-0013205 | | 2/2021 | |
| WO | WO2017073265 | A1 * | 5/2017 | ..... B24B 37/013 |

OTHER PUBLICATIONS

English translation of WO 2017073265A1 (Year: 2017).*
English translation of CN 101006562A (Year: 2007).*
English translation of JP5153894B2 (Year: 2013).*
Office Action issued in Corresponding CN Patent Application No. 202280040078.9, dated Jan. 31, 2026, along with an English translation thereof.
International Search Report issued in International Patent Application No. PCT/JP2022/010113, dated Apr. 26, 2022, along with an English translation thereof.
International Preliminary Report on Patentability issued in International Patent Application No. PCT/JP2022/010113, dated Nov. 21, 2023, along with an English translation thereof.
Office Action issued in Corresponding KR Patent Application No. 10-2023-7041346, dated Apr. 15, 2025, along with an English translation thereof.
Office Action issued in Corresponding KR Patent Application No. 10-2023-7041346, dated Nov. 28, 2024, along with an English translation thereof.

* cited by examiner

CONVENTIONAL EXAMPLE

EXAMPLE

CONVENTIONAL EXAMPLE

EXAMPLE

DOUBLE-SIDE POLISHING APPARATUS AND DOUBLE-SIDE POLISHING METHOD FOR WORKPIECES

TECHNICAL FIELD

The present disclosure relates to a double-side polishing apparatus and double-side polishing method for workpieces.

BACKGROUND

In the production of semiconductor wafers such as silicon wafers, which is a typical example of workpieces to be polished, a double-side polishing process of polishing the front and back sides of the wafers is commonly used in order to achieve more accurate flatness quality and surface roughness quality of the wafers.

Especially in recent years, miniaturization of semiconductor elements and diameter increase of semiconductor wafers have enhanced the requirement for the flatness of semiconductor wafers during light exposure. Hence, a technique of terminating polishing in a timely manner is strongly needed.

In typical double-side polishing, in the initial stage of polishing, the shape of the whole surface of a wafer is convex upward, and the wafer greatly sags at its periphery. At this time, the thickness of the wafer is sufficiently greater than the thickness of a carrier plate. Subsequently, as the polishing progresses, the whole surface of the wafer becomes flatter, but the periphery of the wafer remains sagging. At this time, the thickness of the wafer is slightly greater than the thickness of the carrier plate. As the polishing progresses further, the whole surface of the wafer becomes substantially flat and the periphery of the wafer comes to be less sagging. At this time, the thickness of the wafer is substantially equal to the thickness of the carrier plate. Subsequently, as the polishing progresses, the shape of the wafer is gradually depressed at the center, and the periphery of the wafer comes to have a raised shape (i.e. a shape that increases in thickness outward in the wafer radial direction). At this time, the thickness of the wafer is less than the thickness of the carrier plate.

Accordingly, a wafer is typically polished until the thickness of the wafer becomes substantially equal to the thickness of the carrier plate, in order to obtain a wafer having high flatness over the whole surface and the periphery. An operator adjusts the polishing time to control the polishing amount.

However, the adjustment of the polishing time by the operator is significantly affected by polishing environments, such as the timing of replacing subsidiary materials for polishing or deviation in the timing of stopping the apparatus. Therefore, the polishing amount cannot always be controlled accurately, and much reliance is placed on the experience of the operator.

In view of this, for example, JP 2010-030019 A (PTL 1) proposes a double-side polishing apparatus for wafers capable of measuring the thickness of a wafer through monitoring holes (through holes) from above an upper plate (or from below a lower plate) in real time during polishing and determining the polishing termination timing based on the measurement result.

In the double-side polishing apparatus described in PTL 1, the timing of terminating double-side polishing is determined based on the measured thickness of the wafer, so that polishing can be terminated when a preset thickness is obtained. However, there is a problem in that the shape of the wafer after the polishing does not match the target shape.

Hence, JP 2019-118975 A (PTL 2) by the present applicant proposes a double-side polishing apparatus capable of measuring the thickness of a wafer during double-side polishing in real time, determining a shape index of the entire wafer from the measured thickness of the wafer, and terminating the double-side polishing at the timing when the entire wafer has the target shape during the double-side polishing.

Moreover, JP 2020-15122 A (PTL 3) by the present applicant proposes a double-side polishing apparatus and double-side polishing method as an improvement over the technique described in PTL 2, wherein, with life variations of subsidiary materials such as polishing pads, carrier plates, and slurry in the double-side polishing apparatus for workpieces being taken into account, double-side polishing can be terminated at the timing when the entire wafer has the target shape even in the case where double-side polishing of wafers is repeatedly performed in batches.

CITATION LIST

Patent Literature

PTL 1: JP 2010-030019 A
PTL 2: JP 2019-118975 A
PTL 3: JP 2020-15122 A

SUMMARY

Technical Problem

In recent years, semiconductor devices are increasingly miniaturized and highly integrated, and the device formation region is expanding outward in the wafer radial direction. For this reason, high flatness is now required of the peripheral portion of the wafer as well. There is thus a growing need for a double-side polishing apparatus capable of terminating double-side polishing at the timing when not only the entire wafer but also the peripheral portion of the wafer has the target shape. In this regard, the double-side polishing apparatus described in PTL 3 has room for improvement as the shape of the peripheral portion of the wafer is not taken into account when determining the timing of terminating double-side polishing.

It could therefore be helpful to provide a double-side polishing apparatus and double-side polishing method for workpieces capable of terminating double-side polishing at the timing when the entire workpiece and the peripheral portion of the workpiece each have the target shape during the double-side polishing.

Solution to Problem

We provide the following:

[1] A double-side polishing apparatus for workpieces, comprising: rotating plates including an upper plate and a lower plate, one of the upper plate and the lower plate having one or more monitoring holes that penetrate from an upper surface to a lower surface of the one of the upper plate and the lower plate; a sun gear provided at a center portion of the rotating plates; an internal gear provided at a peripheral portion of the rotating plates; a carrier plate provided between the upper plate and the lower plate and having one or more wafer holding holes for holding a workpiece; one or more workpiece thickness measuring devices configured to measure a thickness of each workpiece through the one or more monitoring holes in real time during double-side polishing of the workpiece; and a computing section configured to determine a timing of terminating the double-side polishing of the workpiece during the double-side polishing of the workpiece, wherein the computing section is configured to perform: a first step of grouping thickness data of workpieces measured by the one or more workpiece thickness measuring devices, for each workpiece; a second step of extracting, for each workpiece, shape components of the workpiece from thickness data of the workpiece; a third step of identifying, for each of the extracted shape components of the workpiece, a position on the workpiece in a workpiece radial direction at which the shape component is measured; a fourth step of calculating a shape distribution of the workpiece from the identified positions on the workpiece in the workpiece radial direction and the shape components of the workpiece; a fifth step of obtaining a shape index of the entire workpiece from the calculated shape distribution of the workpiece; and a sixth step of determining, as the timing of terminating the double-side polishing of the workpiece, a timing at which the shape index of the entire workpiece obtained for each workpiece is a set value of the shape index of the entire workpiece determined based on a difference between a target value of the shape index of the entire workpiece in a current batch and an actual value of the shape index of the entire workpiece in a preceding batch and a deviation of an actual value of a shape index of a peripheral portion of the workpiece in the preceding batch from a target range of the shape index of the peripheral portion of the workpiece in the current batch, and the computing section is configured to terminate the double-side polishing of the workpiece at the determined timing of terminating the double-side polishing of the workpiece.

[2] The double-side polishing apparatus for workpieces according to [1], wherein the set value Y of the shape index of the entire workpiece is expressed by the following formula (1) where A is the target value in the current batch, B is the actual value in the preceding batch, C is a set value of the shape index of the entire workpiece in the preceding batch, D is a constant, E is a correction amount to the target value A based on the deviation of the actual value of the shape index of the peripheral portion of the workpiece in the preceding batch from the target range of the shape index of the peripheral portion of the workpiece in the current batch, and a is an adjustment sensitivity constant where $0<a\leq 1$, and the correction amount E in the formula (1) is expressed by the following formula (2) where F is the actual value of the shape index of the peripheral portion of the workpiece in the preceding batch, G is a lower limit of the target range of the shape index of the peripheral portion of the workpiece in the current batch, His an upper limit of the target range, I is a constant, and b is an adjustment sensitivity constant where $0<b\leq 1$,

[Math. 1]

$$Y = C + \frac{A - B - E}{D} \times a \tag{1}$$

-continued

[Math. 2]

$$E = \begin{cases} 0 & (G \leq F \leq H) \\ \frac{F - G}{I} \times b & (F < G) \\ \frac{F - H}{I} \times b & (F > H) \end{cases} \tag{2}$$

[3] The double-side polishing apparatus for workpieces according to [1] or [2], wherein in the third step, the position on the workpiece in the workpiece radial direction at which each of the shape components is measured is identified by actually measuring a distance between a center of the sun gear and a center of the monitoring hole, a rotation angle of the carrier plate, and a revolution angle of the carrier plate, or by calculating by simulation a measurable interval during which the thickness of the workpiece is measurable with respect to various conditions of a rotation speed of the upper plate, a revolution number of the carrier plate, and a rotation number of the carrier plate and identifying the rotation speed of the upper plate, the revolution number of the carrier plate, and the rotation number of the carrier plate at which the calculated measurable interval and an interval during which measurement is actually possible best match.

[4] The double-side polishing apparatus for workpieces according to any one of [1] to [3], wherein in the sixth step, a relationship between the shape index of the entire workpiece and a polishing time is linearly approximated and, from an approximated straight line, a polishing time at which the shape index of the entire workpiece is the set value is determined as the timing of terminating the double-side polishing of the workpiece.

[5] The double-side polishing apparatus for workpieces according to any one of [1] to [4], wherein in the fifth step, a relationship between the shape components of the workpiece and the positions on the workpiece in the workpiece radial direction is approximated by an even function, and the shape index of the entire workpiece is determined based on a maximum value and a minimum value of the approximated even function.

[6] The double-side polishing apparatus for workpieces according to any one of [1] to [5], wherein in the first step, the thickness data of the workpieces is grouped for each workpiece based on a time interval during which the thickness data of the workpiece is continuously measured.

[7] The double-side polishing apparatus for workpieces according to any one of [1] to [6], wherein in the second step, a relationship between the thickness data of the workpiece and a polishing time is approximated by a quadratic function, and a difference between the thickness data of the workpiece and the approximated quadratic function is taken to be a shape component of the workpiece.

[8] A double-side polishing method for workpieces, wherein a workpiece is held in a carrier plate having one or more wafer holding holes for holding the workpiece, the workpiece is sandwiched between rotating plates composed of an upper plate and a lower plate, and rotation and revolution of the carrier plate are controlled by rotation of a sun gear provided at a center portion of the rotating plates and rotation of an internal gear provided at a peripheral portion of the rotating plates to thereby rotate the rotating plates and the carrier plate relative to each other and polish both sides of the workpiece simultaneously, one of the upper plate and the lower plate having one or more monitoring holes that penetrate from an upper surface to a lower surface of the one of the upper plate and the lower plate, the double-side polishing method for workpieces comprises, during double-side polishing of the workpiece: a first step of grouping thickness data of workpieces measured by a workpiece thickness measuring device, for each workpiece; a second step of extracting, for each workpiece, shape components of the workpiece from thickness data of the workpiece; a third step of identifying, for each of the extracted shape components of the workpiece, a position on the workpiece in a workpiece radial direction at which the shape component is measured; a fourth step of calculating a shape distribution of the workpiece from the identified positions on the workpiece in the workpiece radial direction and the shape components of the workpiece; a fifth step of obtaining a shape index of the entire workpiece from the calculated shape distribution of the workpiece; and a sixth step of determining, as a timing of terminating the double-side polishing of the workpiece, a timing at which the shape index of the entire workpiece obtained for each workpiece is a set value of the shape index of the entire workpiece determined based on a difference between a target value of the shape index of the entire workpiece in a current batch and an actual value of the shape index of the entire workpiece in a preceding batch and a deviation of an actual value of a shape index of a peripheral portion of the workpiece in the preceding batch from a target range of the shape index of the peripheral portion of the workpiece in the current batch, and the double-side polishing of the workpiece is terminated at the determined timing of terminating the double-side polishing of the workpiece.

[9] The double-side polishing method for workpieces according to [8], wherein the set value Y of the shape index of the entire workpiece is expressed by the following formula (3) where A is the target value in the current batch, B is the actual value in the preceding batch, C is a set value of the shape index of the entire workpiece in the preceding batch, D is a constant, E is a correction amount to the target value A based on the deviation of the actual value of the shape index of the peripheral portion of the workpiece in the preceding batch from the target range of the shape index of the peripheral portion of the workpiece in the current batch, and a is an adjustment sensitivity constant where $0<a\leq 1$, and the correction amount E in the formula (3) is expressed by the following formula (4) where F is the actual value of the shape index of the peripheral portion of the workpiece in the preceding batch, G is a lower limit of the target range of the shape index of the peripheral portion of the workpiece in the current batch, H is an upper limit of the target range, I is a constant, and b is an adjustment sensitivity constant where $0<b\leq 1$,

[Math. 3]

$$Y = C + \frac{A - B - E}{D} \times a \tag{3}$$

-continued

[Math. 4]

$$E = \begin{cases} 0 & (G \leq F \leq H) \\ \frac{F - G}{I} \times b & (F < G) \\ \frac{F - H}{I} \times b & (F > H) \end{cases} \tag{4}$$

[10] The double-side polishing method for workpieces according to [8] or [9], wherein in the third step, the position on the workpiece in the workpiece radial direction at which each of the shape components is measured is identified by actually measuring a distance between a center of the sun gear and a center of the monitoring hole, a rotation angle of the carrier plate, and a revolution angle of the carrier plate, or by calculating by simulation a measurable interval during which the thickness of the workpiece is measurable with respect to various conditions of a rotation speed of the upper plate, a revolution number of the carrier plate, and a rotation number of the carrier plate and identifying the rotation speed of the upper plate, the revolution number of the carrier plate, and the rotation number of the carrier plate at which the calculated measurable interval and an interval during which measurement is actually possible best match.

[11] The double-side polishing method for workpieces according to any one of [8] to [10], wherein in the sixth step, a relationship between the shape index of the entire workpiece and a polishing time is linearly approximated and, from an approximated straight line, a polishing time at which the shape index of the entire workpiece is the set value is determined as the timing of terminating the double-side polishing of the workpiece.

[12] The double-side polishing method for workpieces according to any one of [8] to [11], wherein in the fifth step, a relationship between the shape components of the workpiece and the positions on the workpiece in the workpiece radial direction is approximated by an even function, and the shape index of the entire workpiece is determined based on a maximum value and a minimum value of the approximated even function.

[13] The double-side polishing method for workpieces according to any one of [8] to [12], wherein in the first step, the thickness data of the workpieces is grouped for each workpiece based on a time interval during which the thickness data of the workpiece is continuously measured.

[14] The double-side polishing method for workpieces according to any one of [8] to [13], wherein in the second step, a relationship between the thickness data of the workpiece and a polishing time is approximated by a quadratic function, and a difference between the thickness data of the workpiece and the approximated quadratic function is taken to be a shape component of the workpiece.

Advantageous Effect

It is thus possible to terminate double-side polishing at the timing when the entire workpiece and the peripheral portion of the workpiece each have the target shape during the double-side polishing.

DETAILED DESCRIPTION (Double-Side Polishing Apparatus for Workpieces)

Figure 1:
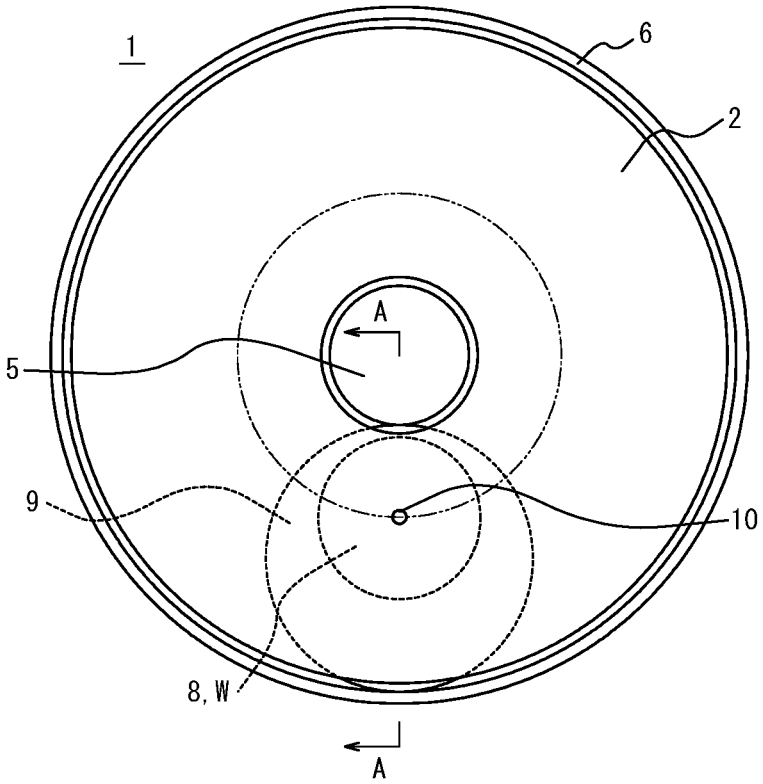
FIG. 1 is a top view of a double-side polishing apparatus for workpieces according to an embodiment of the present disclosure.
Figure 2:
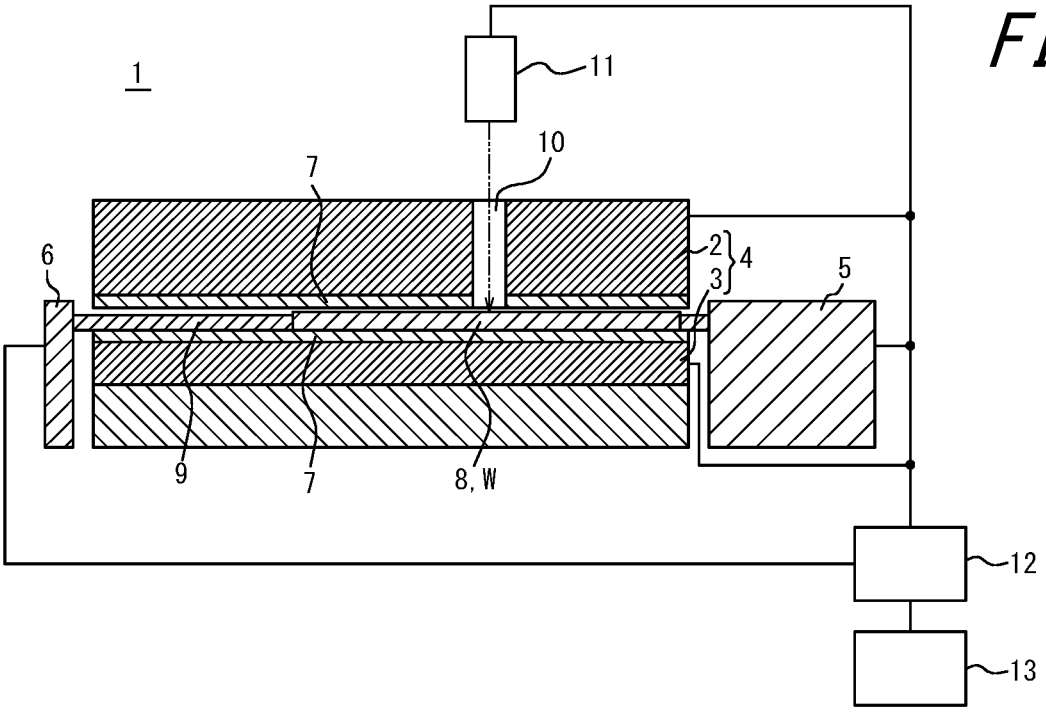
FIG. 2 is a cross-sectional view taken along line A-A in FIG. 1.

An embodiment of a double-side polishing apparatus for workpieces according to the present disclosure will be described in detail below with reference to the drawings. FIG. 1 is a top view of a double-side polishing apparatus for workpieces according to an embodiment of the present disclosure. FIG. 2 is a cross-sectional view taken along line A-A in FIG. 1. As illustrated in FIGS. 1 and 2, a double-side polishing apparatus 1 includes: rotating plates 4 including an upper plate 2 and a lower plate 3 facing each other; a sun gear 5 provided at the center of rotation of the rotating plates 4; and an internal gear 6 provided in a ring shape around the rotating plates 4. As illustrated in FIG. 2, a polishing pad 7 is attached to each of the surfaces of the upper and lower rotating plates 4 facing each other, i.e. the lower surface of the upper plate 2 as a polishing surface and the upper surface of the lower plate 3 as a polishing surface.

As illustrated in FIGS. 1 and 2, the apparatus 1 also includes a plurality of carrier plates 9 that are provided between the upper plate 2 and the lower plate 3 and each have one or more workpiece holding holes 8 (one workpiece holding hole 8 in the illustrated example) for holding workpieces. Only one of the plurality of carrier plates 9 is illustrated in FIG. 1. The number of workpieces holding holes 8 is not limited as long as it is one or more. For example, the number of workpieces holding holes 8 may be three. In the illustrated example, a workpiece (a wafer W in this embodiment) is held in the workpiece holding hole 8.

The apparatus 1 is a planetary gearing double-side polishing apparatus that can cause planetary motion involving orbital motion and rotational motion of each carrier plate 9 by rotating the sun gear 5 and the internal gear 6. In detail, while polishing slurry is supplied, the carrier plate 9 is caused to perform planetary motion, and at the same time the upper plate 2 and the lower plate 3 are rotated relative to the carrier plate 9. Thus, the respective polishing pads 7 attached to the upper and lower rotating plates 4 and both sides of the wafer W held in the workpiece holding hole 8 of the carrier plate 9 can be made to slide against each other to thereby polish both sides of the wafer W simultaneously.

As illustrated in FIGS. 1 and 2, the upper plate 2 in the apparatus 1 in this embodiment has one or more monitoring holes 10 penetrating from the upper surface of the upper plate 2 to the lower surface of the upper plate 2 as a polishing surface. In the illustrated example, one monitoring hole 10 is provided at such a position that passes through the vicinity of the center of the wafer W. Although the monitoring hole 10 is provided in the upper plate 2 in this example, the monitoring hole 10 may be provided in the lower plate 3. In other words, one or more monitoring holes 10 are provided in the upper plate 2 or the lower plate 3. Although one monitoring hole 10 is provided in the example illustrated in FIGS. 1 and 2, a plurality of monitoring holes 10 may be arranged in the upper plate 2 in the circumferential direction (on the two-dot chain line in FIG. 1). Here, the monitoring hole 10 penetrates from the upper surface of the upper plate 2 to the lower surface of the polishing pad 7, as illustrated in FIG. 2.

As illustrated in FIG. 2, the apparatus 1 includes, above the upper plate 2 in the illustrated example, one or more workpiece thickness measuring devices 11 (one workpiece thickness measuring device 11 in the illustrated example) capable of measuring the thickness of the wafer W through one or more monitoring holes 10 (one monitoring hole 10 in the illustrated example) in real time during the double-side polishing of the wafer W. In this example, each workpiece thickness measuring device 11 is a wavelength tunable infrared laser device. For example, the workpiece thickness measuring device 11 may include an optical unit that irradiates the wafer W with laser light, a detection unit that detects the laser light reflected from the wafer W, and a computing unit that calculates the thickness of the wafer W from the detected laser light. Such a workpiece thickness measuring device 11 can calculate the thickness of the wafer W from the difference in optical path length between the laser light incident on the wafer W and reflected off the front surface of the wafer W and the laser light incident on the wafer W and reflected off the back surface of the wafer W. The workpiece thickness measuring device 11 is not limited to the foregoing device using infrared laser, and may be any device capable of measuring the thickness of the wafer W in real time. The workpiece thickness measuring device 11 is not fixed to the upper plate 2 having the monitoring hole 10 (the lower plate 3 in the case where the lower plate 3 has the monitoring hole 10), and does not rotate integrally with the upper plate 2 (the lower plate 3 in the case where the lower plate 3 has the monitoring hole 10).

As illustrated in FIG. 2, the double-side polishing apparatus 1 in this embodiment includes a control section 12. In this example, the control section 12 is connected to the upper plate 2, the lower plate 3, the sun gear 5, the internal gear 6, and the workpiece thickness measuring device 11, as illustrated in FIG. 2.

The double-side polishing apparatus 1 in this embodiment includes a computing section 13 that determines, during the double-side polishing of the wafer W, the timing of terminating the double-side polishing of the wafer W. The computing section 13 is connected to the control section 12. The computing section 13 acquires workpiece thickness data measured by the workpiece thickness measuring device 11, and determines the timing of terminating the double-side polishing of the wafer W. The operation of the computing section 13 will be described below, using an example in which one workpiece thickness measuring device 11 composed of an infrared laser is provided, five monitoring holes 10 are evenly spaced in the upper plate 2 in the circumferential direction, the number of carrier plates 9 is five, and one wafer W as a workpiece is held in each carrier plate 9.

First, the computing section 13 groups the thickness data of the wafers W (i.e. the data of the thicknesses of the wafers W) measured by the workpiece thickness measuring device 11, for each wafer W (first step). The thicknesses of the wafers W are accurately measured by the workpiece thickness measuring device 11 when the surface of the wafers W are irradiated with laser light emitted from the workpiece thickness measuring device 11 through the monitoring holes 10 in the upper plate 2.

On the other hand, when the laser light illuminates the upper surface of the upper plate 2 without passing through the monitoring holes 10 or when the laser light passes through the monitoring holes 10 but illuminates the surfaces of the carrier plates 9 instead of the surfaces of the wafers W, the thicknesses of the wafers W are not acquired. Hereafter, a continuous time interval during which the thickness of a wafer W is measured by the workpiece thickness measuring device 11 is referred to as a "measurable interval", and a time interval during which the thickness of a wafer W is not measured accurately is referred to as an "immeasurable interval".

In some cases, the shapes of the wafers W cannot be accurately evaluated even when using data obtained in the measurable intervals if the data greatly vary. In such a case, the shapes of the wafers W can be evaluated by averaging, for each monitoring hole 10, the data obtained in the measurable intervals.

Specifically, since the upper plate 2 has five monitoring holes 10 for measuring thickness as mentioned above, for example when the upper plate 2 is rotated at 20 rpm (3-second cycle), laser light from the workpiece thickness measuring device 11 passes through the monitoring holes 10 at intervals of 0.6 seconds. In the case where the time required to pass through the diameter (for example, 15 mm) of each monitoring hole 10 (i.e. the time required to cross the monitoring hole 10) is 0.01 seconds, the time interval between a measurable interval of a certain monitoring hole 10 and the next measurable interval of the monitoring hole 10, that is, an immeasurable interval, is 0.01 seconds or more and 0.59 seconds or less. Accordingly, in the case where the immeasurable interval is 0.01 seconds or more and 0.59 seconds or less, continuous data measured up to the immeasurable interval is regarded as data obtained by continuous measurement through one of the monitoring holes 10 and is averaged, and it is determined that the measurement proceeds to the next monitoring hole 10. Even when a monitoring hole 10 passes right below the workpiece thickness measuring device 11, an immeasurable interval occurs if no wafer W is present under the monitoring hole 10. Accordingly, in the case where the measurement proceeds from the monitoring hole 10 in the current measurement to the second one over the monitoring hole 10, the time interval between the current measurable interval and the next measurable interval, that is, the immeasurable interval, is 0.59 seconds or more and 1.19 seconds or less.

Even such data that is averaged as described above may contain outliers, for example in the case where the thickness of the outermost peripheral portion of the wafer is measured. In the case where the data contains such outliers, the shape of the wafer W cannot be evaluated accurately. It is therefore preferable to first remove the outliers from the measured thickness data.

Figure 3:
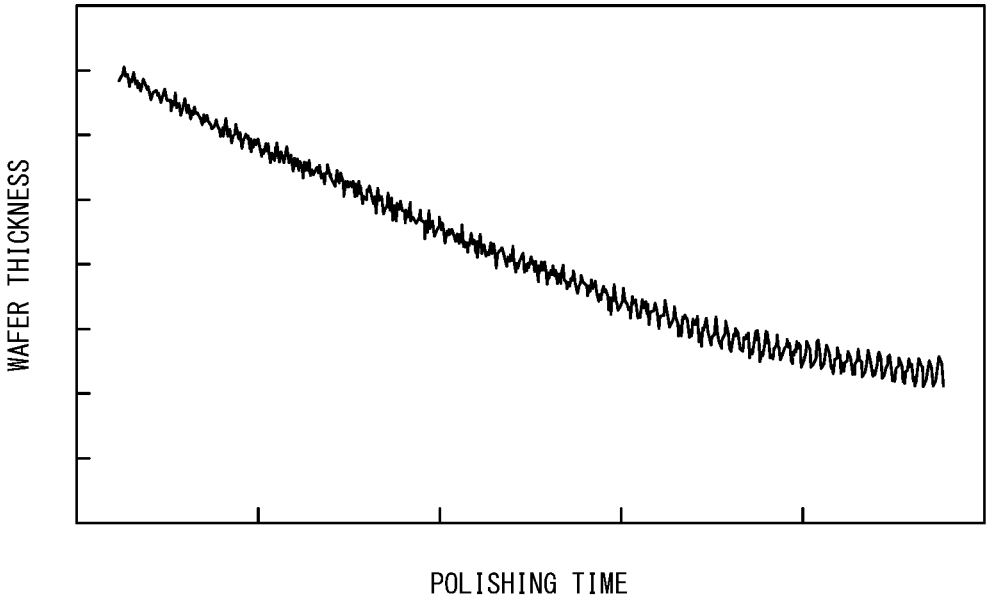
FIG. 3 is a diagram illustrating an example of thickness data of wafers from which outliers have been removed.

The removal of the outliers can be performed based on the initial thickness of the carrier plates 9, the initial thickness of the wafers W, etc. Moreover, with a certain number of measurement values of the wafer thickness obtained, statistically, for example, data whose standard deviation exceeds a predetermined value (for example, 0.2 μm) may be removed as outliers. Hereafter, the values left after removing the outliers are referred to as "normal values". FIG. 3 illustrates an example of the thickness data of the wafers W from which outliers have been removed.

When the wafers W are double-side polished under typical polishing conditions, measurable intervals and immeasurable intervals for the thicknesses of the wafers W alternate in such a manner that a measurable interval is followed by an immeasurable interval, which is followed by a measurable interval. Here, the occurrence of an immeasurable interval means that the wafer W irradiated with laser light is changed. Thus, thickness data measured in measurable intervals can be grouped for each wafer W using such occurrence of an immeasurable interval as an index.

Our studies revealed that, after the thickness of one wafer W held in one carrier plate 9 is measured in a measurable interval and an immeasurable interval occurs thereafter, a wafer W whose thickness is measured in the next measurable interval is not always a wafer held in a carrier plate 9 adjacent to the one carrier plate 9, but may be a wafer held in a carrier plate 9 that is two or more carrier plates away from the one carrier plate 9.

Specifically, suppose carrier plates 9 labeled A, B, C, D, and E are annularly arranged in this order and revolve so that the carrier plates will move toward the workpiece thickness measuring device 11 in the order of A, B, C, D, E, A, B, . . . . After the thickness of the wafer W held in the carrier plate 9 labeled A is measured, an immeasurable interval occurs. Then, a wafer W measured in the following measurable interval may be the wafer W held in the carrier plate 9 labeled C two carrier plates away from the carrier plate 9 labeled A. In this case, the time period of the immeasurable interval is longer than in the case where the wafer W in the adjacent carrier plate 9 labeled B is measured.

Accordingly, for example, whether the thickness of the wafer W in the carrier plate 9 labeled B or the thickness of the wafer W in the carrier plate 9 labeled C or D was measured after the wafer W in the carrier plate 9 labeled A can be determined based on the time period of the immeasurable interval, that is, the time interval between the measurable interval and the next measurable interval. Thus, the thickness data of the wafers W can be correctly grouped for each wafer W.

Figure 4:
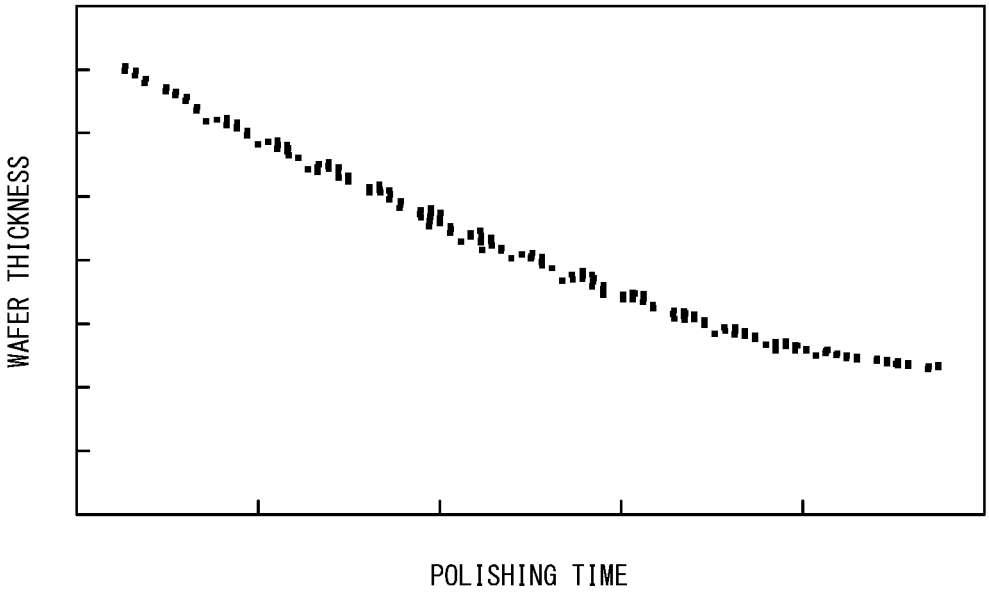
FIG. 4 is a diagram illustrating thickness data of one wafer W separated from the thickness data illustrated in FIG. 3.

FIG. 4 illustrates the thickness data of one wafer W separated from the thickness data illustrated in FIG. 3. For each of the other four wafers W, too, the thickness data of the wafer W having similar tendency as that illustrated in FIG. 4 is obtained, although not illustrated.

Next, the computing section 13 performs the following steps on the thickness data of the wafers W grouped on a wafer W basis. First, the computing section 13 extracts the shape components of the wafer W from the thickness data of the wafer W (second step). The thickness of each wafer W grouped in the first step decreases as the polishing time increases. In detail, the average thickness of the wafer W decreases as the polishing time increases, so that the thickness data obtained in the first step not only contains temporal variation in the shape components of the surface of the wafer W but also temporal variation in the average thickness of the wafer W. Hence, the temporal variation in the average thickness of the wafer W is removed from the thickness data of the wafer W to extract the temporal variation in the shape components of the surface of the wafer W.

Figure 5:
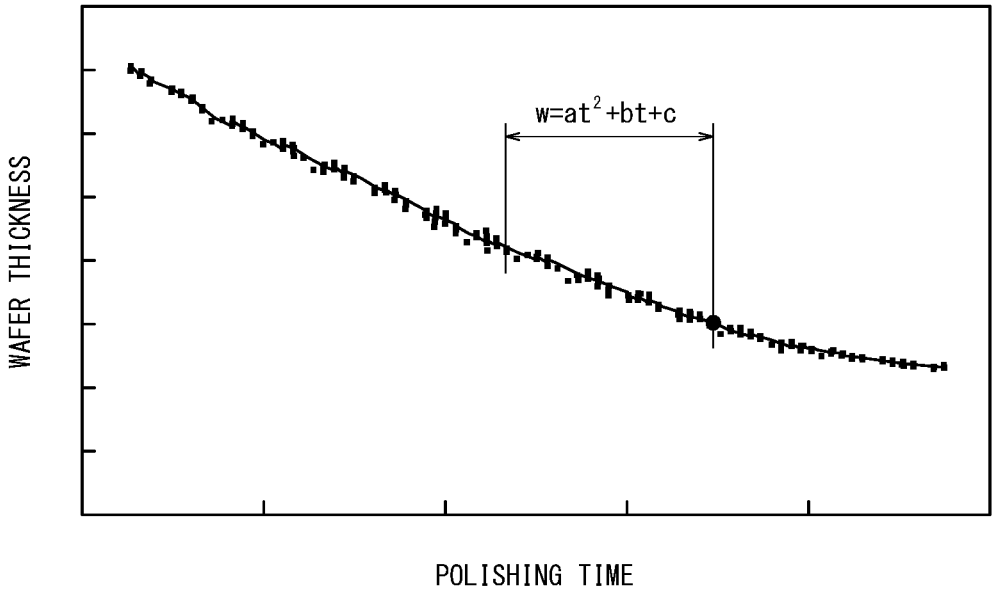
FIG. 5 is a diagram illustrating temporal variation in the average thickness of the wafer obtained by approximating the thickness data of the wafer illustrated in FIG. 4 by a quadratic function.
Figure 6:
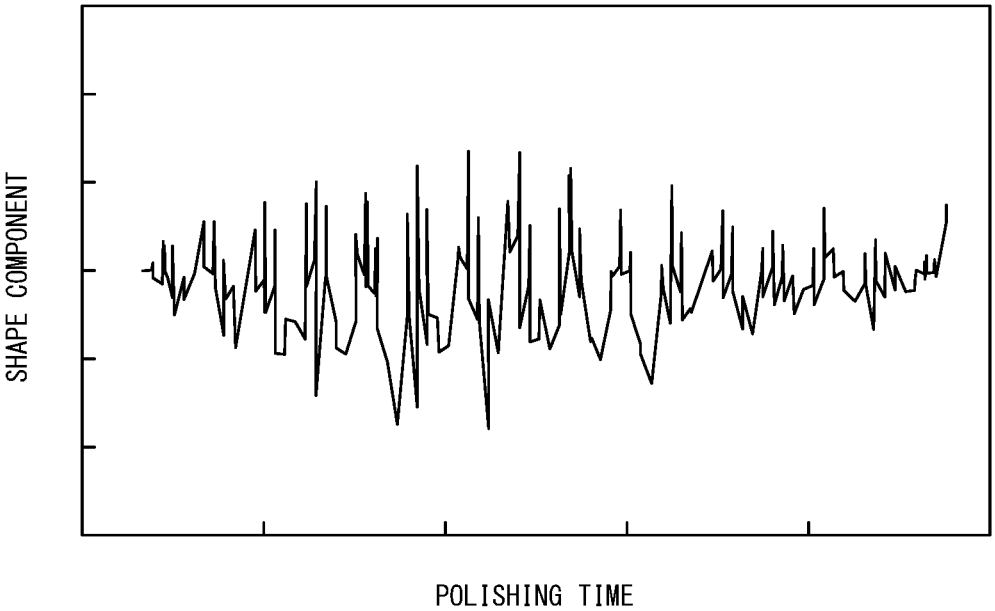
FIG. 6 is a diagram illustrating temporal variation in the shape components of the surface of the wafer extracted from the thickness data of the wafer illustrated in FIG. 4.

The temporal variation in the average thickness of the wafer W can be approximated by a quadratic function. FIG. 5 illustrates the temporal variation in the average thickness of the wafer W obtained by approximating the thickness data of the wafer W illustrated in FIG. 4 by a quadratic function. As illustrated in the drawing, the thickness data of the wafer W can be well fitted with a quadratic function. The temporal variation in the average thickness of the wafer W can thus be obtained. The temporal variation in the average thickness of the wafer W obtained in this way is then subtracted from the thickness data of the wafer W, as a result of which the temporal variation in the shape components of the surface of the wafer W can be extracted. FIG. 6 illustrates the obtained temporal variation in the shape components.

Figure 7:
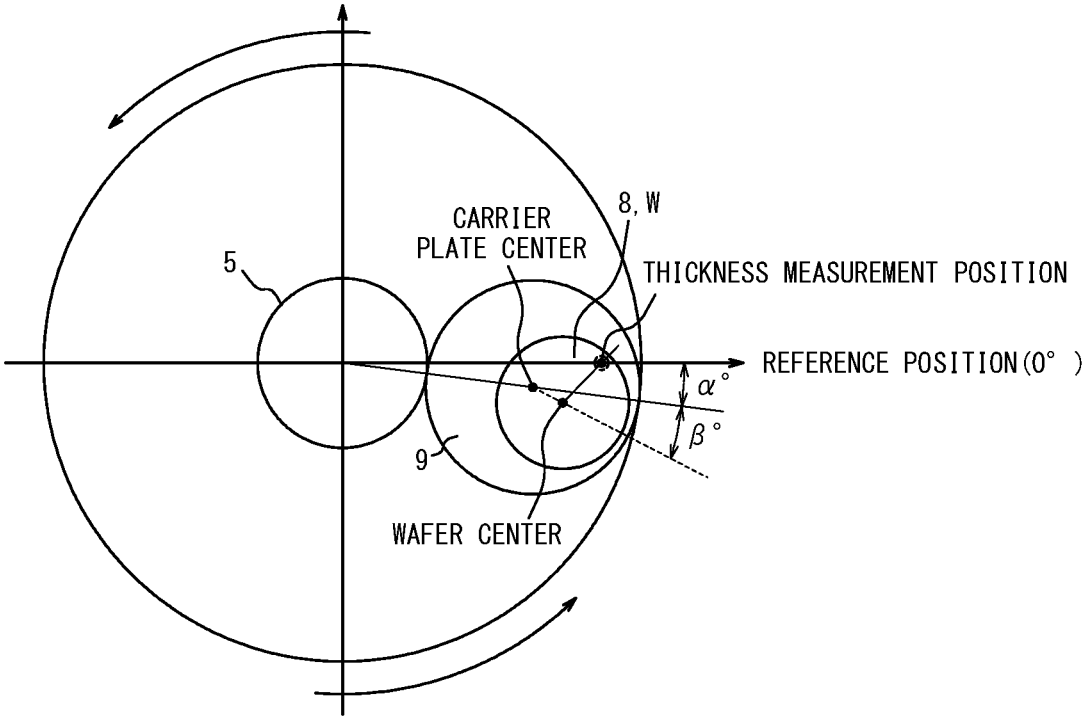
FIG. 7 is a diagram illustrating an example of the positional relationship between a carrier plate and a wafer at a time point when the thickness of the wafer is measured.

Subsequently, for each shape component of the wafer W extracted as described above, the computing section 13 identifies the measurement position on the wafer W in the wafer radial direction, i.e. the distance from the wafer center (third step). FIG. 7 illustrates an example of the positional relationship between the carrier plate 9 and the wafer W at a time point when the thickness of the wafer W is measured. In the drawing, the thickness measurement position (i.e. the position of the wafer thickness measuring device 11 or the position of the center of the monitoring hole 10) lies on the reference line, and the distance from the center of the sun gear 5 to the thickness measurement position (i.e. the distance from the center of the sun gear 5 to the center of the monitoring hole 10) is a design value and therefore is a known constant. Likewise, the radii of the rotating plates 4, sun gear 5, and carrier plate 9 and the distance from the center of the carrier plate 9 to the center of the wafer W are design values and therefore are known constants.

$\alpha$ is the revolution angle of the carrier plate 9, and indicates the angle between the reference position (reference line) and the line joining the center of the sun gear 5 and the center of the carrier plate 9. $\beta$ is the rotation angle of the carrier plate 9, and indicates the angle between the line joining the center of the sun gear 5 and the center of the carrier plate 9 and the line joining the center of the carrier plate 9 and the center of the wafer W.

Not only in the double-side polishing apparatus 1 according to the present disclosure but in typical double-side polishing apparatuses, the angle (or the displacement) from the reference position (reference line) is monitored and controlled using a device called an encoder, in order to check whether the rotating plates 4, the carrier plates 9, etc. are rotating under set conditions. Accordingly, the revolution angle $\alpha$ and the rotation angle $\beta$ at the time point of measurement of the thickness of the wafer W can be identified. Then, the center position of the carrier plate 9 can be determined from the identified revolution angle $\alpha$, and the center position of the wafer W can be determined from the identified rotation angle $\beta$. Since the distance from the center of the sun gear 5 to the thickness measurement position (i.e. the center of the monitoring hole 10) is known as mentioned above, the computing section 13 can determine the distance from the center of the wafer W to the thickness measurement position, that is, the position of each shape component of the wafer W in the wafer radial direction.

Thus, the position of each shape component of the wafer W in the wafer radial direction can be determined from the radii of the rotating plates 4, sun gear 5, and carrier plate 9, the distance from the center of the carrier plate 9 to the center of the wafer W, the position of the wafer thickness measuring device 11 (i.e. the distance from the center of the sun gear 5 to the center of the monitoring hole 10) which are design values, and (1) the revolution angle $\alpha$ of the carrier plate 9 and (2) the rotation angle $\beta$ of the carrier plate 9 at the time of measurement of the thickness of the wafer W.

As mentioned above, (1) the revolution angle $\alpha$ of the carrier plate 9 and (2) the rotation angle $\beta$ of the carrier plate 9 can be obtained by actual measurement. The actual measurement of these values, however, requires high accuracy. It is therefore preferable that the position of each shape component of the wafer W in the wafer radial direction is determined by identifying (1) and (2) by simulation from the pattern of measurable intervals in a certain time period (for example, 200 seconds) from the start of polishing.

Specifically, using the rotation speed (rpm) of the upper plate 2, the revolution number (rpm) of the carrier plate 9, and the rotation number (rpm) of the carrier plate 9, which are polishing conditions, and the initial position of the wafer W (the revolution angle $\alpha$ and the rotation angle $\beta$ of the wafer W from the reference position (reference line) in FIG. 7), which is an initial parameter, the computing section 13 can obtain the time pattern (i.e. the pattern of the measurable intervals) in which the thickness of the wafer W is measured and the relevant position subjected to the thickness measurement (i.e. the position of the shape component of the wafer W in the wafer radial direction) by simulation.

The computing section 13 then determines the rotation speed (rpm) of the upper plate 2, the revolution number (rpm) of the carrier plate 9, and the rotation number (rpm) of the carrier plate 9 at which the pattern of the measurable intervals found by simulation best matches the pattern of the measurable intervals obtained by actual measurement, to identify the position where the thickness is measured. The computing section 13 can thus determine the position of each shape component of the wafer W in the wafer radial direction by simulation.

Next, the computing section 13 calculates the shape distribution of the wafer W from the identified positions on the wafer W in the wafer radial direction and the shape components of the wafer W (fourth step). The shape distribution can be calculated using the shape components corresponding to different measurement positions. In the present disclosure, the shape distribution of the wafer W at polishing time t is calculated using the shape components obtained from the thickness data measured from polishing time t-$\Delta$t to polishing time t.

Figure 8A:
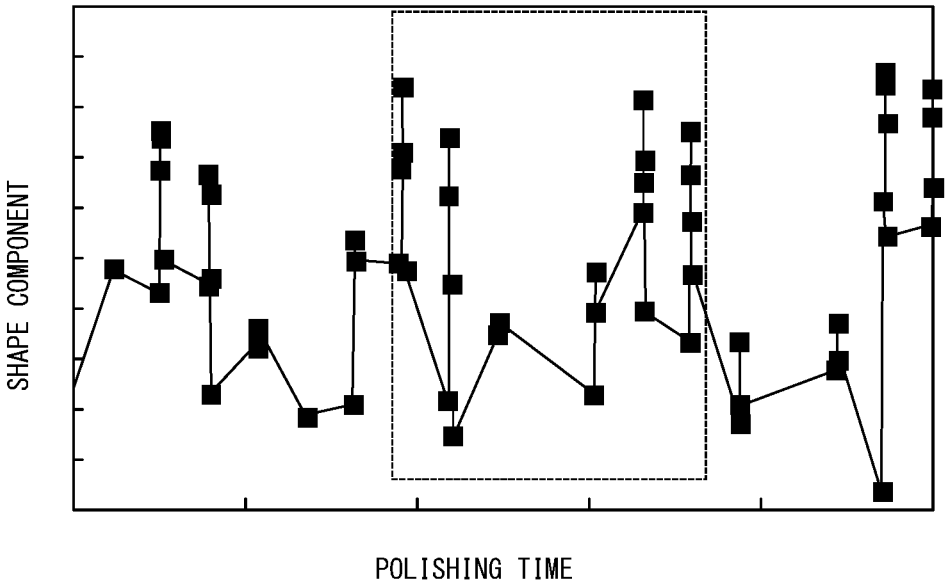
FIG. 8A is an enlarged view of part of the temporal variation in the shape distribution illustrated in FIG. 6 corresponding to polishing time from 500 seconds to 1000 seconds.
Figure 8B:
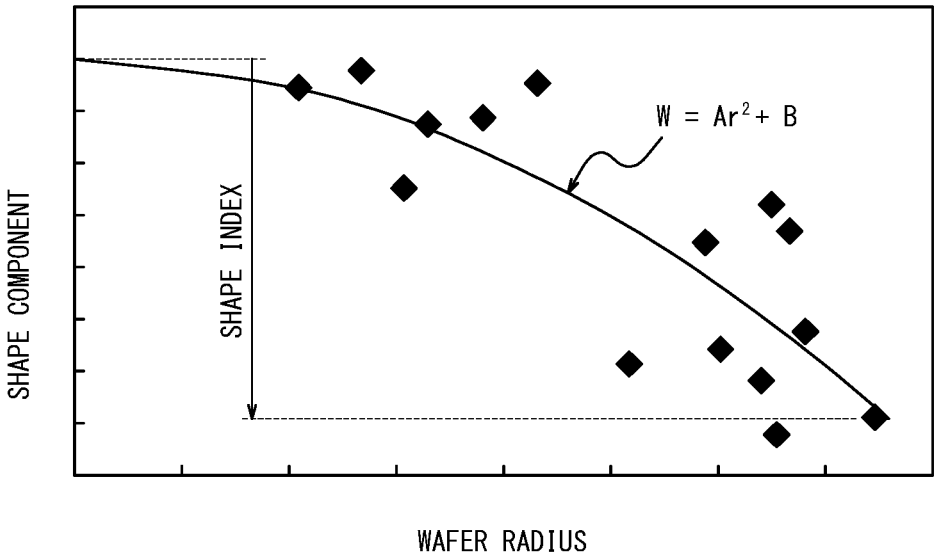
FIG. 8B is the shape distribution of the wafer obtained from FIG. 8A.

FIG. 8A is an enlarged view of part of the temporal variation in the shape distribution illustrated in FIG. 6 corresponding to polishing time from 500 seconds to 1000 seconds. For example, the shape distribution of the wafer W at a polishing time of 880 seconds is determined using the shape components from 680 seconds to 880 seconds in the illustrated example. FIG. 8B illustrates the obtained shape distribution. As is clear from the above description, the obtained shape distribution of the wafer W indicates not the shape distribution at polishing time t but the average shape distribution of the wafer W from polishing time t-Δt to polishing time t.

The time range for the shape components used to determine the shape distribution depends on the number of pieces of measurable data per unit time and depends on the polishing conditions. When the time range is longer, the accuracy of the shape distribution is higher but the time required to calculate the shape distribution is longer. When the time range is shorter, the time required to calculate the shape distribution is shorter but the accuracy of the shape distribution is lower. We discovered that, by determining the shape distribution of the wafer W using shape components in a time range of 75 seconds or more, for example, it is possible to determine the shape distribution of the wafer W with high accuracy while reducing the time required for the calculation of the shape distribution. It is more preferable to determine the shape distribution of the wafer W using shape components in a time range of 200 seconds or more and 300 seconds or less.

Next, the shape index of the entire wafer W is obtained from the shape distribution of the wafer W calculated as described above (fifth step). One of the indices representing the flatness of the wafer W is the global backside ideal range (GBIR). The GBIR is an index representing the global flatness of the entire wafer. The GBIR can be determined as the difference between the maximum and minimum thicknesses of the wafer W with the back surface of the wafer W as a reference plane.

In the present disclosure, the GBIR is used as the shape index of the entire wafer W. However, the obtained GBIR is the average GBIR in the time range from t-Δt to t for the shape components used for the calculation of the shape distribution, and is not a GBIR in a strict sense. For this reason, the difference between the maximum value and the minimum value of the shape distribution is herein referred to as the "shape index of the entire wafer W".

As in the example illustrated in FIG. 8B, in the case where the number of shape components is insufficient, the shape distribution is approximated by an even function, and the maximum value and the minimum value are determined from the resultant shape distribution of the wafer W expressed by the even function. The shape index of the wafer W can then be calculated from the difference between the determined maximum value and the minimum value.

In the case where the shape components in the vicinity of the center of the wafer W are obtained, a biquadratic function is preferably used as the even function because the shape distribution of the wafer W can be well reproduced. In the case where the shape distribution in the vicinity of the center of the wafer W is not obtained, a quadratic function is preferably used as the even function because the shape distribution of the wafer W can be well reproduced.

After the shape index of the entire wafer W is obtained for each wafer W as described above, the computing section 13 determines, as the timing of terminating the double-side polishing of the wafer W, the timing at which the shape index of the entire wafer W obtained for each wafer W is a set value of the shape index of the entire wafer W determined based on the difference between the target value of the shape index of the entire wafer W in the current batch and the actual value of the shape index of the entire wafer W in the preceding batch and the deviation of the actual value of the shape index of the peripheral portion of the wafer W in the preceding batch from the target range of the shape index of the peripheral portion of the wafer W in the current batch (sixth step).

As mentioned earlier, PTL 3 by the present applicant proposes a double-side polishing apparatus wherein, with life variations of subsidiary materials such as polishing pads, carrier plates, and slurry in the double-side polishing apparatus being taken into account, double-side polishing can be terminated at the timing when the entire wafer W has the target shape even in the case where double-side polishing of wafers W is repeatedly performed in batches.

In the double-side polishing apparatus proposed in PTL 3, when determining the timing of terminating the double-side polishing of the wafer W, the set value of the shape index of the entire wafer W corresponding to the timing of terminating double-side polishing in the current batch is corrected based on the difference between the actual value and target value of the shape index of the entire wafer W double-side polished in the preceding batch. The target value in this embodiment is the target value in the current batch, which may be different from the target value in the preceding batch. In the case where the target value in the current batch is equal to the target value in the preceding batch, the set value of the shape index of the entire wafer W corresponding to the timing of terminating double-side polishing in the current batch may be corrected based on the difference between the actual value of the shape index of the entire wafer W double-side polished in the preceding batch and the target value in the preceding batch.

Specifically, in batch processing of double-side polishing, the set value of the shape index of the entire wafer W when terminating double-side polishing in the current batch is Y expressed by the following formula (5), where A is the target value, B is the actual value in the preceding batch, D is a constant, C is the set value of the shape index of the entire wafer W in the preceding batch, and a ($0<a\leq 1$) is an adjustment sensitivity constant. In this way, double-side polishing can be terminated at the timing when the entire wafer W has the target shape even in the case where double-side polishing is repeatedly performed in batches.

[Math. 5]

$$Y = C + \frac{A - B}{D} \times a. \tag{5}$$

However, in the double-side polishing apparatus proposed in PTL 3, the shape of the peripheral portion of the wafer W is not taken into account when determining the timing of terminating double-side polishing. Therefore, while double-side polishing can be terminated at the timing when the entire wafer W has the target shape, the peripheral portion of the wafer W after the double-side polishing may not have the target shape.

Figure 9:
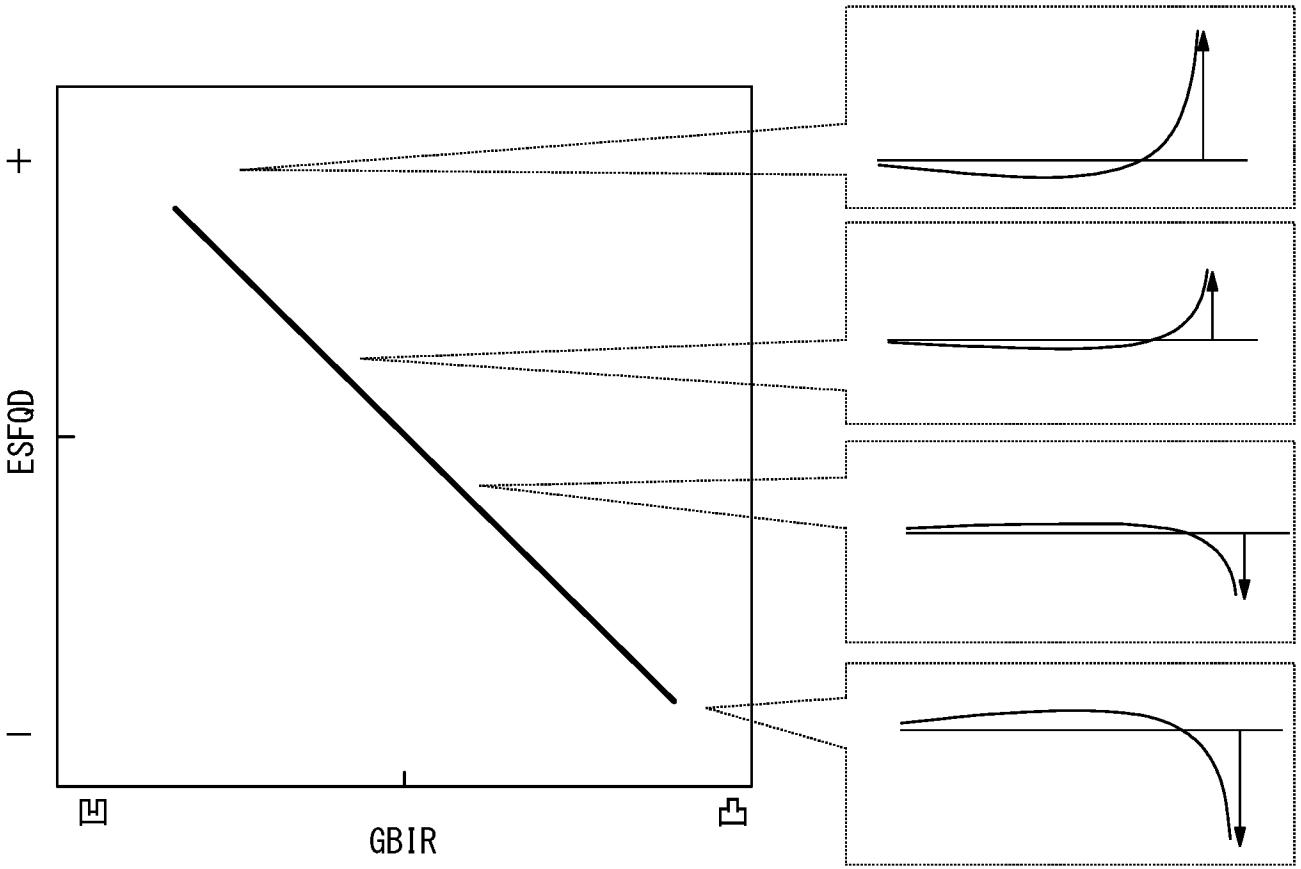
FIG. 9 is a schematic diagram illustrating the correlation between GBIR and ESFQD.

FIG. 9 is a schematic diagram illustrating the relationship between GBIR and ESFQD of a wafer W. The ESFQD (edge site flatness front reference least square deviation) is an index representing the flatness of the peripheral portion of the wafer W. When the maximum absolute value of the ESFQD is smaller, the flatness of the peripheral portion of the wafer W is higher. As illustrated in FIG. 9, the GBIR, which is the shape index of the entire wafer W, and the ESFQD, which is the shape index of the peripheral portion of the wafer W, correlate with each other to some extent. In detail, if the wafer W has a convex shape, the ESFQD of the wafer W has a negative value and tends to roll off. If the wafer W has a concave shape, the ESFQD of the wafer W has a positive value and tends to roll up.

We examined a double-side polishing apparatus for wafers W capable of terminating double-side polishing at the timing when not only the entire wafer W but also the peripheral portion of the wafer W has the target shape during the double-side polishing. As a result, we discovered that it is effective to determine, as the timing of terminating the double-side polishing of the wafer W, the timing at which the shape index of the entire wafer W obtained for each wafer W in the fifth step is the set value of the shape index of the entire wafer W determined based on the difference between the target value of the shape index of the entire wafer W in the current batch and the actual value of the shape index of the entire wafer W in the preceding batch and the deviation of the actual value of the shape index of the peripheral portion of the wafer W in the preceding batch from the target range of the shape index of the peripheral portion of the wafer W in the current batch.

We then closely examined, for many wafers W after double-side polishing, the relationship between the set value and actual value of the shape index of each of the entire wafer W and the peripheral portion of the wafer W when terminating double-side polishing. We consequently discovered that double-side polishing can be terminated at the timing when not only the entire wafer W but also the peripheral portion of the wafer W has the target shape, by setting the set value of the shape index of the entire wafer W when terminating double-side polishing in the current batch to Y expressed by the following formula (6) where A is the target value in the current batch, B is the actual value in the preceding batch, C is the set value of the shape index of the entire wafer W in the preceding batch, D is a constant, E is the correction amount to the target value A based on the deviation of the actual value of the shape index of the peripheral portion of the wafer W in the preceding batch from the target range of the shape index of the peripheral portion of the workpiece in the current batch, and a ($0<a\leq 1$) is an adjustment sensitivity constant. Here, the correction amount E in the formula (6) is expressed by the following formula (7) where F is the actual value of the shape index of the peripheral portion of the wafer W in the preceding batch, G is the lower limit of the target range of the shape index of the peripheral portion of the wafer W in the current batch, H is the upper limit of the target range, I is a constant, and b ($0<b\leq 1$) is an adjustment sensitivity constant.

[Math. 6]

$$Y = C + \frac{A - B - E}{D} \times a \tag{6}$$

[Math. 7]

$$E = \begin{cases} 0 & (G \leq F \leq H) \\ \frac{F - G}{I} \times b & (F < G) \\ \frac{F - H}{I} \times b & (F > H) \end{cases} \tag{7}$$

The constant D in the formula (6) can be calculated by performing statistical analysis on the target value A and the actual value B for many wafers W after actual double-side polishing. For instance, the value of the constant D was calculated at 0.665693 in the below-described example. The adjustment sensitivity constant a is a constant for adjusting the influence of the actual value of the shape index in the preceding batch when determining the set value of the shape index of the entire wafer W in the current batch. Setting a to a value that is greater than 0 and less than or equal to 1 can reduce the influence of the measurement error of the actual value due to the disturbance caused by the life variations of the subsidiary materials such as the polishing pads 7, carrier plates 9, and slurry when measuring the shape index of the entire wafer W in the preceding batch. The value of a may be 0.2, for example.

Similarly, the constant I in the formula (7) can be calculated by performing statistical analysis on the target range (G or more and H or less) and the actual value F for many wafers W after actual double-side polishing. For instance, the value of the constant I was calculated at −88.77 in the below-described example. The adjustment sensitivity constant b is a constant for adjusting the influence of the actual value of the shape index in the preceding batch when determining the set value of the shape index of the peripheral portion of the wafer W in the current batch. Setting b to a value that is greater than 0 and less than or equal to 1 can reduce the influence of the measurement error of the actual value due to the disturbance caused by the life variations of the subsidiary materials such as the polishing pads 7, carrier plates 9, and slurry when measuring the shape index of the peripheral portion of the wafer W in the preceding batch. The value of b may be 0.7, for example.

The target range (G or more and H or less) of the shape index of the peripheral portion of the wafer W is not uniquely set, but is set to an appropriate range based on the specifications. In the present disclosure, as indicated in the formula (7), the correction value E is set to 0 and no correction is made if the actual value F of the shape index of the peripheral portion of the wafer W is within the target range. If the actual value F is less than the lower limit G of the target range, the correction value E is set to a value corresponding to the difference between the actual value F and the lower limit G. If the actual value F is more than the upper limit H of the target range, the correction value E is set to a value corresponding to the difference between the actual value F and the upper limit H. The upper limit H and lower limit G of the target range of the shape index of the peripheral portion of the wafer W in the formula (7) may be the same value, that is, the correction value E may be determined based on the difference between the target value and the actual value F.

In the case where the target value A and the target range of the shape index in the current batch are different from the value and range in the preceding batch or in the case where the difference therebetween is small, the formulas (6) and (7) can be used without any problem. In the case where the difference therebetween is large, the values of the adjustment sensitivity constants a and b may be appropriately adjusted or the upper limit H and lower limit G of the target range may be adjusted.

Thus, after determining the shape index of the entire wafer W for each wafer W, the computing section 13 determines, as the timing of terminating the double-side polishing of the wafer W, the timing at which the shape index of the entire wafer W obtained for each wafer W is the set value of the shape index of the entire wafer W determined based on the difference between the target value of the shape index of the entire wafer W in the current batch and the actual value of the shape index of the entire wafer W in the preceding batch and the deviation of the actual value of the shape index of the peripheral portion of the wafer W in the preceding batch from the target range of the shape index of the peripheral portion of the wafer W in the current batch, and terminates the double-side polishing at the determined timing. It is therefore possible to terminate double-side polishing with the entire wafer W and the peripheral portion of the wafer W each having the target shape during the double-side polishing.

Figure 10:
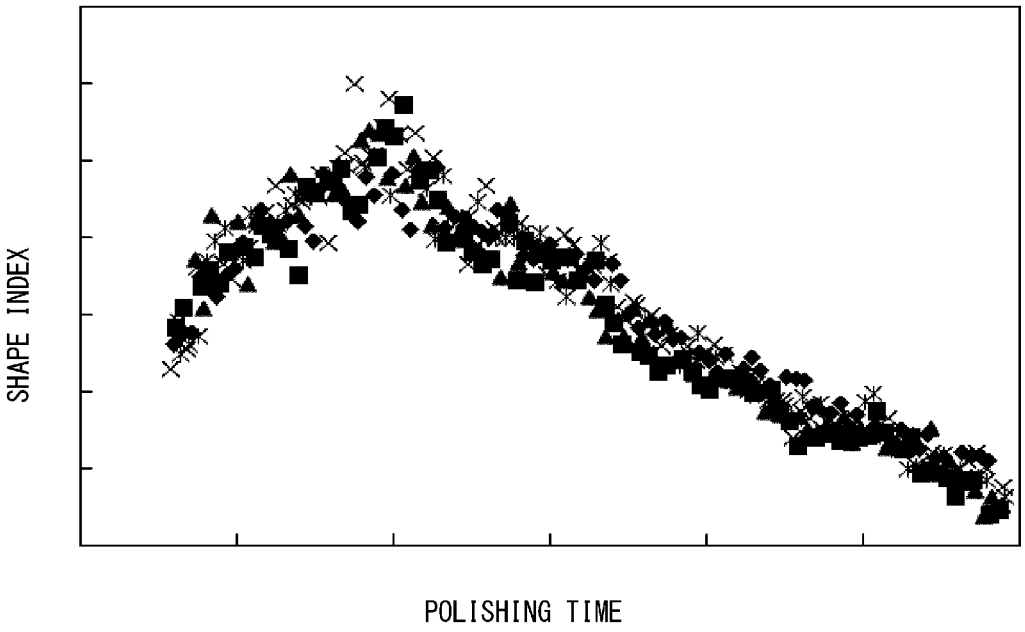
FIG. 10 is a diagram illustrating the relationship between the average value of the shape index of the entire wafer and the polishing time.

In the sixth step, the computing section 13 calculates the average value of the shape index of the entire wafer W obtained for each wafer in the fifth step, and determines the timing of terminating the double-side polishing of the wafer W based on the average value. FIG. 10 illustrates the relationship between the average value of the shape index of the wafer W and the polishing time. In practice, the computing section 13 terminates the double-side polishing at the timing when the shape index of the entire wafer W is the set value Y given by the formula (6).

Figure 11:
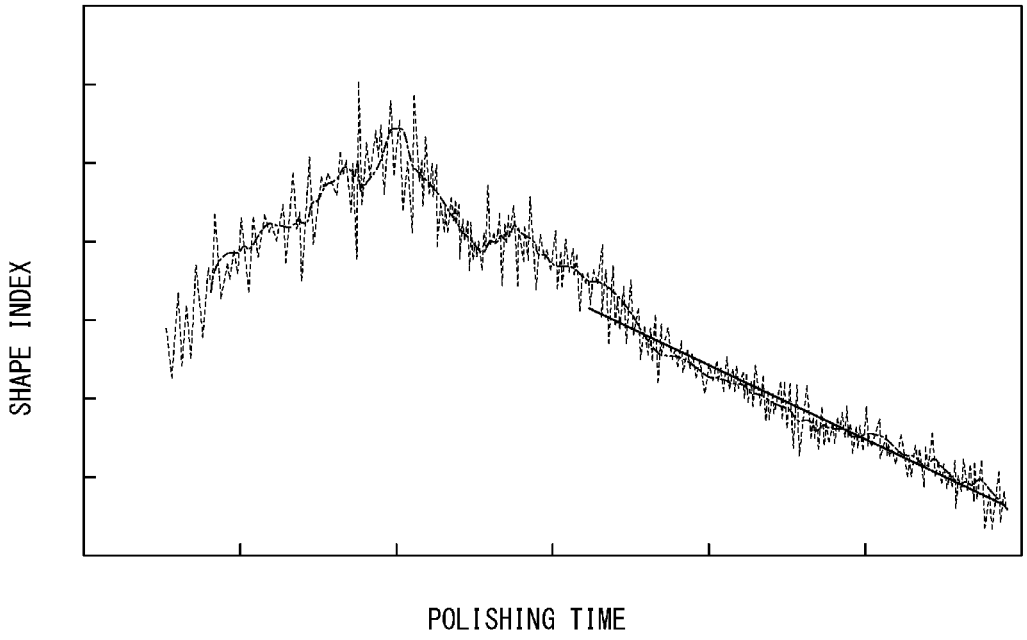
FIG. 11 is a diagram illustrating the shape index of the entire wafer approximated linearly.

Typically, the surface of each wafer W subjected to double-side polishing is relatively flat before polishing, and after double-side polishing starts, the surface shape of the wafer changes, and the flatness degrades temporarily and the GBIR increases. As the double-side polishing continues, however, the flatness improves and the GBIR begins to decrease. When the double-side polishing continues, the GBIR tends to decrease linearly as the polishing time increases. The shape index of the entire wafer W illustrated in FIG. 10, after beginning to decrease, decreases linearly, exhibiting the same tendency as the GBIR. Hence, by linearly approximating the shape index of the entire wafer W after the shape index of the entire wafer W begins to decrease as illustrated in FIG. 11, it is possible to predict the timing at which the shape index of the entire wafer W is the foregoing set value. As a result of the timing of terminating the double-side polishing being set to the timing at which the shape index of the entire wafer W is the set value Y, the double-side polishing can be terminated at the timing when the entire wafer W and the peripheral portion of the wafer W each have the target shape.

(Double-Side Polishing Method for Workpieces)

A double-side polishing method for workpieces according to an embodiment of the present disclosure will be described below. With the method in this embodiment, for example, double-side polishing can be performed on workpieces such as wafers W using the apparatus illustrated in FIGS. 1 and 2. Since the structure of the apparatus illustrated in FIGS. 1 and 2 has already been described, its description is omitted.

Figure 12:
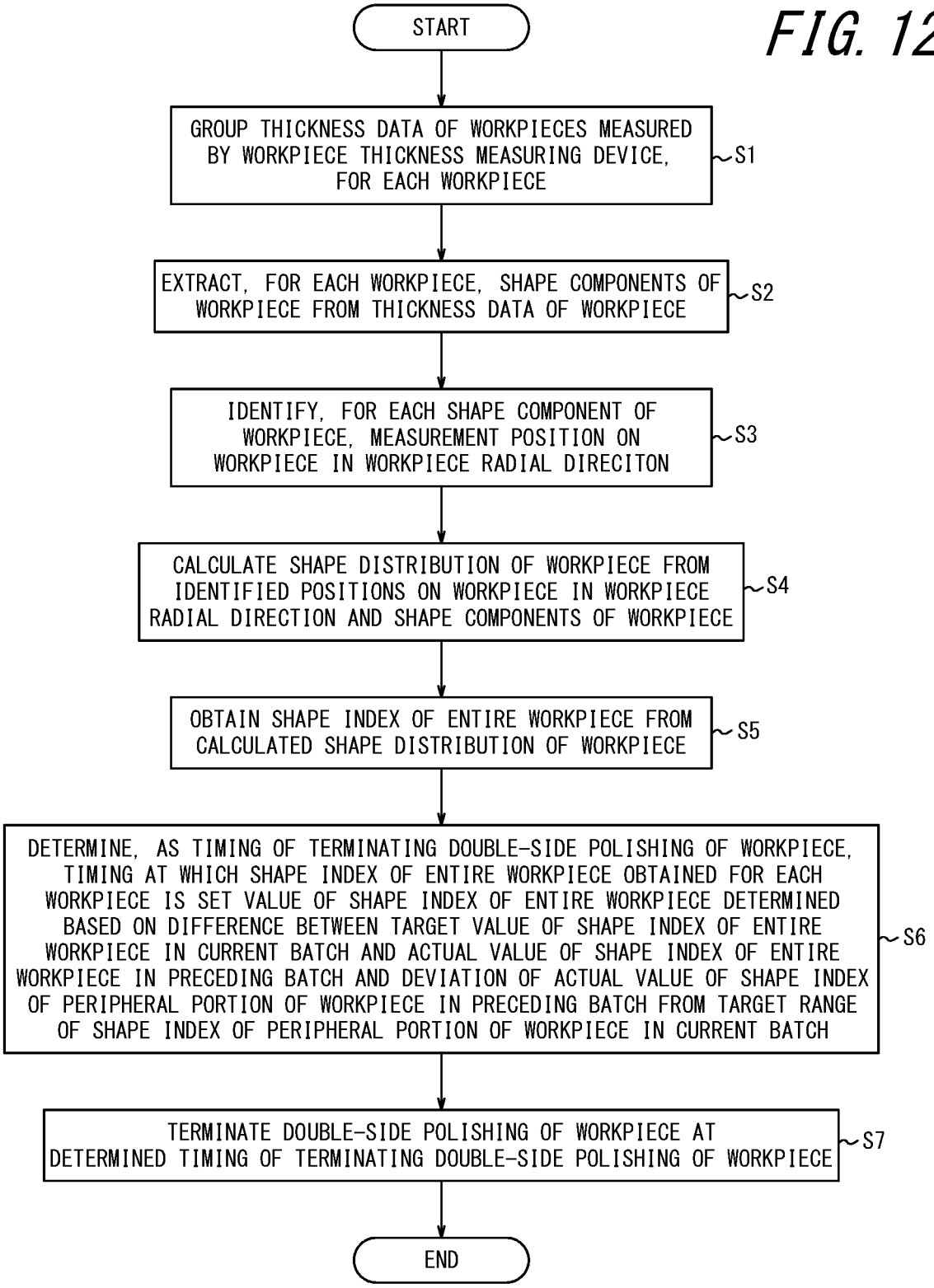
FIG. 12 is a flowchart of a double-side polishing method for workpieces according to the present disclosure.

FIG. 12 is a flowchart of a double-side polishing method for workpieces according to the present disclosure. Since the method according to the present disclosure is the same as the method whereby the computing section 13 in the above-described double-side polishing apparatus for workpieces according to the present disclosure determines the time of terminating double-side polishing, the method will be described briefly while omitting detailed description.

First, before the determination of the timing, outliers are removed from the thickness data of the workpieces such as wafers W measured by the workpiece thickness measuring device 11, to obtain the thickness data of the workpieces composed only of normal values. In step S1, the thickness data of the workpieces from which outliers have been removed is separated on a workpiece basis (first step). This can be performed, for example, based on the time intervals during which the thickness data of the workpieces are continuously measured.

Next, in step S2, for each workpiece, the shape components of the workpiece are extracted from the thickness data of the workpiece (second step). This can be performed, for example, by approximating the thickness data of the workpiece by a quadratic function and subtracting the temporal variation in the average thickness of the workpiece obtained by the approximation by the quadratic function from the temporal variation in the shape components of the workpiece.

Next, in step S3, for each extracted shape component of the workpiece, the measurement position on the workpiece in the workpiece radial direction is identified (third step). The position on the workpiece in the workpiece radial direction at which each shape component is measured can be identified by actually measuring the distance between the center of the sun gear 5 and the center of the monitoring hole 10, the rotation angle $\beta$ of the carrier plate 9, and the revolution angle $\alpha$ of the carrier plate 9 or by calculating by simulation a measurable interval during which the thickness of the workpiece can be measured with respect to various conditions of the rotation speed of the upper plate 2, the revolution number of the carrier plate 9, and the rotation number of the carrier plate 9 and identifying the rotation speed of the upper plate 2, the revolution number of the carrier plate 9, and the rotation number of the carrier plate 9 at which the calculated measurable interval and an interval during which measurement is actually possible best match, as described above.

Next, in step S4, the shape distribution of the workpiece is calculated from the identified positions on the workpiece in the workpiece radial direction and the shape components of the workpiece (fourth step). In the case where the number of shape components is small when calculating the shape distribution, approximation by an even function may be performed to obtain the shape distribution.

Next, in step S5, the shape index of the entire workpiece is obtained from the calculated shape distribution of the workpiece (fifth step). In the present disclosure, the difference between the maximum value and minimum value of the shape distribution of the workpiece is used as the shape index of the entire workpiece.

Next, in step S6, the timing at which the shape index of the entire workpiece obtained for each workpiece is the set value of the shape index of the entire workpiece determined based on the difference between the target value of the shape index of the entire workpiece in the current batch and the actual value of the shape index of the entire workpiece in the preceding batch and the deviation of the actual value of the shape index of the peripheral portion of the workpiece in the preceding batch from the target range of the shape index of the peripheral portion of the workpiece in the current batch is determined as the timing of terminating the double-side polishing of the workpiece (sixth step). This step may involve linearly approximating the relationship between the shape index of the workpiece and the polishing time and setting, from the approximated straight line, the polishing time at which the shape index of the workpiece is a predetermined value (for example, zero) as the timing of terminating the double-side polishing of the workpiece.

The set value of the shape index of the entire workpiece corresponding to the timing of terminating the double-side polishing is then set to Y expressed by the following formula (8) where A is the target value in the current batch, B is the actual value in the preceding batch, C is the set value of the shape index of the entire workpiece in the preceding batch, D is a constant, E is the correction amount to the target value A based on the deviation of the actual value of the shape index of the peripheral portion of the workpiece in the preceding batch from the target range of the shape index of the peripheral portion of the workpiece in the current batch, and a ($0<a\leq1$) is an adjustment sensitivity constant. Thus, the double-side polishing can be terminated at the timing when not only the entire workpiece but also the peripheral portion of the workpiece has the target shape. E in the formula (8) can be expressed by the following formula (9) where I is a constant, F is the actual value of the shape index of the peripheral portion of the workpiece in the preceding batch, G is the lower limit of the target range of the shape index of the peripheral portion of the workpiece in the current batch, H is the upper limit of the target range, and b ($0<b\leq 1$) is an adjustment sensitivity constant.

[Math. 8]

$$Y = C + \frac{A - B - E}{D} \times a \tag{8}$$

[Math. 9]

$$E = \begin{cases} 0 & (G \leq F \leq H) \\ \frac{F - G}{I} \times b & (F < G) \\ \frac{F - H}{I} \times b & (F > H) \end{cases} \tag{9}$$

Finally, in step S7, the double-side polishing is terminated at the determined timing of terminating the double-side polishing of the workpiece. Thus, the double-side polishing can be terminated at the timing when the entire workpiece and the peripheral portion of the workpiece each have the target shape.

The processes of steps S1 to S7 described above can be executed, for example, by the computing section 13 included in the double-side polishing apparatus 1 according to the present disclosure. At least part of the processes may be executed by another computer connected to the double-side polishing apparatus or executed on a cloud network.

EXAMPLES

Example

Figure 13A:
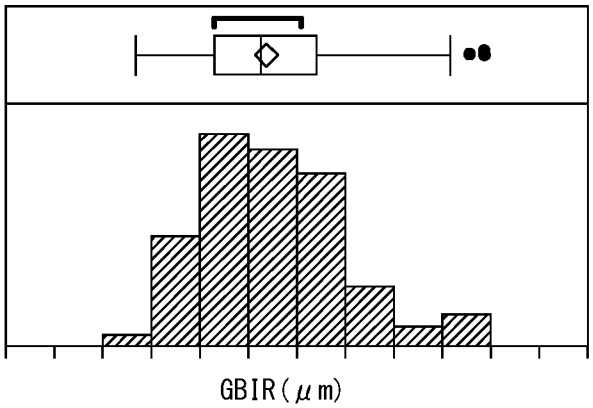
FIG. 13A is a diagram illustrating GBIR of silicon wafers after double-side polishing.
Figure 13B:
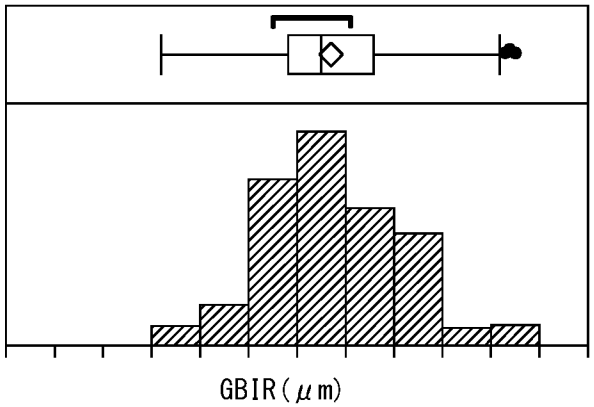
FIG. 13B is a diagram illustrating GBIR of silicon wafers after double-side polishing.
Figure 13C:
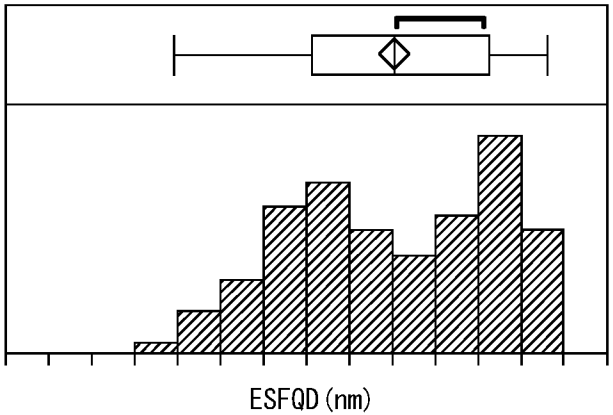
FIG. 13C is a diagram illustrating ESFQD of silicon wafers after double-side polishing.
Figure 13D:
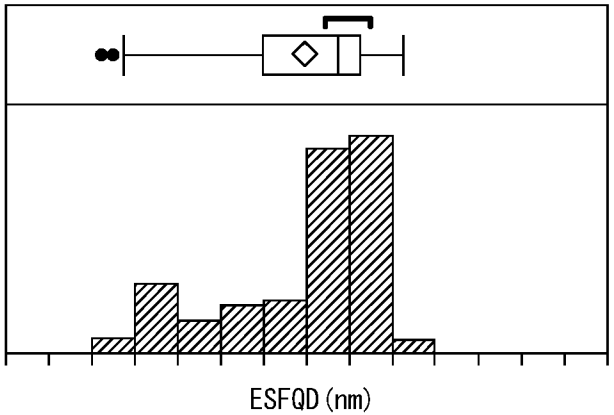
FIG. 13D is a diagram illustrating ESFQD of silicon wafers after double-side polishing.

Five silicon wafers having a diameter of 300 mm were prepared, and subjected to double-side polishing according to the flowchart illustrated in FIG. 12. In step S6, the set value of the shape index of the entire silicon wafer corresponding to the timing of terminating the double-side polishing was determined using the formulas (6) and (7). FIGS. 13B and 13D illustrate the GBIR and ESFQD of the silicon wafers after the double-side polishing, respectively.

Conventional Example

Five silicon wafers having a diameter of 300 mm were subjected to double-side polishing, as with Example. In step S6, the value of the correction amount E was set to 0 without taking into account the deviation of the actual value of the shape index of the peripheral portion of each silicon wafer from the target range. All of the other conditions were the same as those in Example. FIGS. 13A and 13C illustrate the GBIR and ESFQD of the silicon wafers after the double-side polishing, respectively.

As can be understood from a comparison between FIGS. 13A and 13B, the variation in GBIR in Example was similar to that in Conventional Example. As can be understood from a comparison between FIGS. 13C and 13D, the variation in ESFQD in Example was greatly reduced as compared with Conventional Example. It is thus demonstrated that, with the presently disclosed technique, the variation in the shape index of the peripheral portion of the wafer can be greatly reduced while maintaining the variation in the shape index of the entire wafer at a level similar to Conventional Example.

INDUSTRIAL APPLICABILITY

It is thus possible to terminate double-side polishing at the timing when the entire workpiece and the peripheral portion of the workpiece each have the target shape during the double-side polishing. The presently disclosed technique is therefore useful in the semiconductor wafer manufacturing industry.

REFERENCE SIGNS LIST

1 double-side polishing apparatus
2 upper plate
3 lower plate
4 rotating plate
5 sun gear
6 internal gear
7 polishing pad
8 workpiece holding hole
9 carrier plate
10 monitoring hole
11 workpiece thickness measuring device
12 control section
13 computing section
W wafer

The invention claimed is:

1. A double-side polishing apparatus for workpieces, comprising:

rotating plates including an upper plate and a lower plate, one of the upper plate and the lower plate having one or more monitoring holes that penetrate from an upper surface to a lower surface of the one of the upper plate and the lower plate;

a sun gear provided at a center portion of the rotating plates;

an internal gear provided at a peripheral portion of the rotating plates;

a carrier plate provided between the upper plate and the lower plate and having one or more wafer holding holes for holding a workpiece;

one or more workpiece thickness measuring devices configured to measure a thickness of each workpiece through the one or more monitoring holes in real time during double-side polishing of the workpiece; and a computing section configured to determine a timing of terminating the double-side polishing of the workpiece during the double-side polishing of the workpiece, wherein the computing section is configured to perform:

grouping thickness data of workpieces measured by the one or more workpiece thickness measuring devices, for each workpiece;

extracting, for each workpiece, shape components of the workpiece from thickness data of the workpiece;

identifying, for each of the extracted shape components of the workpiece, a position on the workpiece in a workpiece radial direction at which the shape component is measured;

calculating a shape distribution of the workpiece from the identified positions on the workpiece in the workpiece radial direction and the shape components of the workpiece;

obtaining a shape index of the entire workpiece from the calculated shape distribution of the workpiece; and determining, as the timing of terminating the double-side polishing of the workpiece, a timing at which the shape index of the entire workpiece obtained for each workpiece is a set value Y of the shape index of the entire workpiece determined based on a difference between a target value of the shape index of the entire workpiece in a current batch and an actual value of the shape index of the entire workpiece in a preceding batch and a deviation of an actual value of a shape index of a peripheral portion of the workpiece in the preceding batch from a target range of the shape index of the peripheral portion of the workpiece in the current batch, and the computing section terminates the double-side polishing of the workpiece at the determined timing of terminating the double-side polishing of the workpiece, wherein the set value Y of the shape index of the entire workpiece is expressed by the following formula (1) where A is the target value in the current batch, B is the actual value in the preceding batch, C is a set value of the shape index of the entire workpiece in the preceding batch, D is a constant, E is a correction amount to the target value A based on the deviation of the actual value of the shape index of the peripheral portion of the workpiece in the preceding batch from the target range of the shape index of the peripheral portion of the workpiece in the current batch, and a is an adjustment sensitivity constant where $0<a\leq 1$, and the correction amount E in the formula (1) is expressed by the following formula (2) where F is the actual value of the shape index of the peripheral portion of the workpiece in the preceding batch, G is a lower limit of the target range of the shape index of the peripheral portion of the workpiece in the current batch, His an upper limit of the target range, I is a constant, and b is an adjustment sensitivity constant where $0<b\leq 1$.

[Formula 1]

$$Y = C + \frac{A - B - E}{D} \times a \tag{1}$$

[Formula 2]

$$E = \begin{cases} 0 & (G \leq F \leq H) \\ \frac{F - G}{I} \times b & (F < G) \\ \frac{F - H}{I} \times b & (F > H) \end{cases} \tag{2}$$

2. The double-side polishing apparatus for workpieces according to claim 1, wherein in the identifying of the position on the workpiece, the position on the workpiece in the workpiece radial direction at which each of the shape components is measured is identified by actually measuring a distance between a center of the sun gear and a center of the monitoring hole, a rotation angle of the carrier plate, and a revolution angle of the carrier plate, or by calculating by simulation a measurable interval during which the thickness of the workpiece is measurable with respect to various conditions of a rotation speed of the upper plate, a revolution number of the carrier plate, and a rotation number of the carrier plate and identifying the rotation speed of the upper plate, the revolution number of the carrier plate, and the rotation number of the carrier plate at which the calculated measurable interval and an interval during which measurement is actually possible best match.

3. The double-side polishing apparatus for workpieces according to claim 1, wherein in the determining of the timing, a relationship between the shape index of the entire workpiece and a first polishing time is linearly approximated and, from an approximated straight line, a second polishing time at which the shape index of the entire workpiece is the set value is determined as the timing of terminating the double-side polishing of the workpiece.

4. The double-side polishing apparatus for workpieces according to claim 1, wherein in the obtaining of the shape index, a relationship between the shape components of the workpiece and the positions on the workpiece in the workpiece radial direction is approximated by an even function, and the shape index of the entire workpiece is determined based on a maximum value and a minimum value of the approximated even function.

5. The double-side polishing apparatus for workpieces according to claim 1, wherein in the grouping of the thickness data, the thickness data of the workpieces is grouped for each workpiece based on a time interval during which the thickness data of the workpiece is continuously measured.

6. The double-side polishing apparatus for workpieces according to claim 1, wherein in the extracting of the shape components, a relationship between the thickness data of the workpiece and a polishing time is approximated by a quadratic function, and a difference between the thickness data of the workpiece and the approximated quadratic function is taken to be a shape component of the workpiece.

7. A double-side polishing method for workpieces, wherein a workpiece is held in a carrier plate having one or more wafer holding holes for holding the workpiece, the workpiece is sandwiched between rotating plates composed of an upper plate and a lower plate, and rotation and revolution of the carrier plate are controlled by rotation of a sun gear provided at a center portion of the rotating plates and rotation of an internal gear provided at a peripheral portion of the rotating plates to thereby rotate the rotating plates and the carrier plate relative to each other and polish both sides of the workpiece simultaneously, one of the upper plate and the lower plate having one or more monitoring holes that penetrate from an upper surface to a lower surface of the one of the upper plate and the lower plate, the double-side polishing method for workpieces comprises, during double-side polishing of the workpiece:

grouping thickness data of workpieces measured by a workpiece thickness measuring device, for each workpiece;

extracting, for each workpiece, shape components of the workpiece from thickness data of the workpiece;

identifying, for each of the extracted shape components of the workpiece, a position on the workpiece in a workpiece radial direction at which the shape component is measured;

calculating a shape distribution of the entire workpiece from the identified positions on the workpiece in the workpiece radial direction and the shape components of the workpiece;

obtaining a shape index of the workpiece from the calculated shape distribution of the workpiece; and determining, as a timing of terminating the double-side polishing of the workpiece, a timing at which the shape index of the entire workpiece obtained for each workpiece is a set value Y of the shape index of the entire workpiece determined based on a difference between a target value of the shape index of the entire workpiece in a current batch and an actual value of the shape index of the entire workpiece in a preceding batch and a deviation of an actual value of a shape index of a peripheral portion of the workpiece in the preceding batch from a target range of the shape index of the peripheral portion of the workpiece in the current batch, and the double-side polishing of the workpiece is terminated at the determined timing of terminating the double-side polishing of the workpiece, wherein the set value Y of the shape index of the entire workpiece is expressed by the following formula (3) where A is the target value in the current batch, B is the actual value in the preceding batch, C is a set value of the shape index of the entire workpiece in the preceding batch, D is a constant, E is a correction amount to the target value A based on the deviation of the actual value of the shape index of the peripheral portion of the workpiece in the preceding batch from the target range of the shape index of the peripheral portion of the workpiece in the current batch, and a is an adjustment sensitivity constant where $0<a\leq 1$, and the correction amount E in the formula (3) is expressed by the following formula (4) where F is the actual value of the shape index of the peripheral portion of the workpiece in the preceding batch, G is a lower limit of the target range of the shape index of the peripheral portion of the workpiece in the current batch, His an upper limit of the target range, I is a constant, and b is an adjustment sensitivity constant where $0<b\leq 1$.

[Formula 3]

$$Y = C + \frac{A - B - E}{D} \times a \tag{3}$$

[Formula 4]

$$E = \begin{cases} 0 & (G \leq F \leq H) \\ \frac{F - G}{I} \times b & (F < G) \\ \frac{F - H}{I} \times b & (F > H) \end{cases} \tag{4}$$

8. The double-side polishing method for workpieces according to claim 7, wherein in the identifying of the position on the workpiece, the position on the workpiece in the workpiece radial direction at which each of the shape components is measured is identified by actually measuring a distance between a center of the sun gear and a center of a monitoring hole from the one or more monitoring holes, a rotation angle of the carrier plate, and a revolution angle of the carrier plate, or by calculating by simulation a measurable interval during which a thickness of the workpiece is measurable with respect to various conditions of a rotation speed of the upper plate, a revolution number of the carrier plate, and a rotation number of the carrier plate and identifying the rotation speed of the upper plate, the revolution number of the carrier plate, and the rotation number of the carrier plate at which the calculated measurable interval and an interval during which measurement is actually possible best match.

9. The double-side polishing method for workpieces according to claim 7, wherein in the determining of the timing, a relationship between the shape index of the entire workpiece and a first polishing time is linearly approximated and, from an approximated straight line, a second polishing time at which the shape index of the entire workpiece is the set value is determined as the timing of terminating the double-side polishing of the workpiece.

10. The double-side polishing method for workpieces according to claim 7, wherein in the obtaining of the shape index, a relationship between the shape components of the workpiece and the positions on the workpiece in the workpiece radial direction is approximated by an even function, and the shape index of the entire workpiece is determined based on a maximum value and a minimum value of the approximated even function.

11. The double-side polishing method for workpieces according to claim 7, wherein in the grouping of the thickness data, the thickness data of the workpieces is grouped for each workpiece based on a time interval during which the thickness data of the workpiece is continuously measured.

12. The double-side polishing method for workpieces according to claim 7, wherein in the extracting of the shape components, a relationship between the thickness data of the workpiece and a polishing time is approximated by a quadratic function, and a difference between the thickness data of the workpiece and the approximated quadratic function is taken to be a shape component of the workpiece.

* * * * *